US008079594B1

(12) United States Patent
Greenawalt

(10) Patent No.: US 8,079,594 B1
(45) Date of Patent: Dec. 20, 2011

(54) BOARD GAME WITH 3D DYNAMIC GAMEPLAY

(76) Inventor: Thomas H. Greenawalt, Palm Harbor, FL (US)

( * ) Notice: Subject to any disclaimer, the term of this patent is extended or adjusted under 35 U.S.C. 154(b) by 0 days.

(21) Appl. No.: 12/849,307

(22) Filed: Aug. 3, 2010

Related U.S. Application Data

(63) Continuation-in-part of application No. 11/306,682, filed on Jan. 6, 2006, now Pat. No. 7,766,335.

(51) Int. Cl.
*A63F 3/00* (2006.01)

(52) U.S. Cl. ..... 273/241; 273/287

(58) Field of Classification Search ..... 273/241, 273/280, 283, 284, 287, 281, 282
See application file for complete search history.

(56) References Cited

U.S. PATENT DOCUMENTS

| | | | |
|---|---|---|---|
| 3,514,111 | A | 5/1970 | Crawford |
| 3,606,334 | A | 9/1971 | Pippin |
| 3,884,475 | A | 5/1975 | Munro et al. |
| 4,333,655 | A | 6/1982 | Rudell et al. |
| 4,569,527 | A | 2/1986 | Rosenwinkel et al. |
| 6,481,714 | B1 | 11/2002 | Jacobs |

*Primary Examiner* — Vishu Mendiratta
(74) *Attorney, Agent, or Firm* — Robert J. Varkonyi; Smith & Hopen, P.A.

(57) ABSTRACT

A board game incorporating multiple paths of travel which traverse a plurality of elevations with moveable obstacles that change the paths of travel. The moveable obstacles may be transferrable game face members containing moveable structures; such as stairs; bridges and moveable-walls which cut-off some available paths while opening others. Additional obstacles include tunnels, spinning indicators determining the path of travel, vertical obstacles, rotating vehicles, rotating hidden compartments, and linearly sliding vehicles. Through strategic use of the obstacles; players can facilitate their own movement through the game while impeding that of their opponents.

21 Claims, 11 Drawing Sheets

BOARD GAME WITH 3D DYNAMIC GAMEPLAY

CROSS REFERENCE TO RELATED APPLICATION

This application is a continuation-in-part of U.S. Nonprovisional patent application Ser. No. 11/306,682, entitled "Board Game with 3-D Dynamic Game Play", filed on Jan. 6, 2006, the contents of which are herein incorporated by reference.

FIELD OF INVENTION

This invention relates to board games. Specifically, the invention provides a game board allowing dynamic game play through use of obstacles.

BACKGROUND OF THE INVENTION

The present invention relates to a board game and more specifically a game with a game board having multiple elevations and changing paths of travel contained thereon.

Many well-known board games incorporate a game board having a start and exit point with a path of travel, sometimes multiple paths, therebetween. Usually, the path of travel is divided into increments, or segments, wherein movement along the path is determined by the number of segments. For example, a player rolling a six (6) on a dice can move six segments.

It is also known in the art to incorporate game boards that have multiple levels associated with the path of travel. For example, U.S. Pat. No. 6,481,714 to Jacobs describes a game board having three levels with at least one stairway connecting each level. The game board is fashioned to resemble a medieval castle. U.S. Pat. No. 4,569,527 to Rosenwinkel et al. describes a board game in which players construct a mansion during the course of play. The resulting game board has multiple levels connected by stairs. U.S. Pat. No. 3,514,111 to Crawford discloses a two-level board game board meant to simulate astronaut training and orbit around the world. Once a player completes the board containing the United States, a "launch" computer containing rotating dials is used to indicate when the player may advance to the orbital board.

Some game boards have also incorporated moving elements to affect game play, as in altering the path the players must take to win. U.S. Pat. No. 3,606,334 to Pippin describes a flat game board with rotating discs associated with the paths of travel contained thereon. As the discs rotate, the paths of travel are altered. U.S. Pat. No. 4,333,355 to Rudell, et al. describes a vertical game board with pivoting elements designed to simulate rock falls, knocking players from the board.

However, the prior art lacks a board game incorporating the elements of multiple levels associated with changing paths of travel thus rendering each game different from the last.

SUMMARY OF THE INVENTION

The long-standing but heretofore unfulfilled need for a three-dimensional game board having dynamic paths of travel and which also includes other improvements that overcome the limitations of the prior art is now met by a new, useful, and non-obvious invention.

The board game has a game board face, with a plurality of elevated surfaces on the game board. The game board includes at least one start location. The certain embodiments, the board game has a start location and an end location. A plurality of segmented paths runs along the game board face and the elevated surfaces. There can be a common start location, located at the center of the board for example, and a common exit location; alternatively each player can begin the game in a unique start location and move toward a common or player-specific exit location (usually located on a periphery of the board). At least one moveable obstacle is associated with at least one path of travel. The moveable obstacles serve to alter at least one path of travel. In various embodiments the moveable obstacle is at least one moveable obstacle-structure disposed upon the playing surface, with at least one periphery of the obstacle-structure disposed adjacent a portion of a path of travel delineated on the playing surface.

An exemplary obstacle includes a transferrable obstacle, where the transferrable obstacle comprises a game board cooperative element adapted to engage a pocket in the game board. For example, the game board may possess rectangular pockets in the board face, sized to accept the transferrable obstacle and keep the transferrable obstacle from moving when in the pocket. The transferrable obstacle has at least one obstacle on the face of the cooperative element, and includes at least one segmented path of travel on the face of the cooperative element in certain embodiments. The obstacle present on the transferable obstacle may be any obstacle known in the art. Exemplary obstacles include a pivoting wall structure, a pivoting bridge, a sliding bridge, an end-pivoting segmented staircase, a center-pivoting segmented staircase, a sliding segmented staircase, a floor, a spinning floor element, a tunnel, a rotating hidden compartment element, a vertical obstacle, a reciprocating arm, a rotating vehicles, a sliding vehicle, and a pivoting vehicle. Alternatively, the obstacle is a moveable-wall structure rotatably disposed on the face of the cooperative element and a disc rotatably disposed under the face of the cooperative element and comprising at least one peripheral path of travel delineated on the upper face, where the at least one peripheral path of travel delineated on the upper face of the disc is visible through a window in the cooperative element. The moveable wall optionally also includes a segmented path of travel disposed on the top face of the wall.

Another potential obstacle includes a spinning floor element, which uses a rotating element pivotally connected to the playing surface, with markings disposed on the face of the rotating element showing whether the player may travel along the rotating element. The markings are visible through a window on the playing surface. A rotating element, such as a obelisk, tower, or a cylindrical knob. The spinning floor element may be randomly spun, similar to a roulette wheel, resulting in dynamic paths of travel. The marks delineated on the face of the rotating element indicate the status of the coinciding segment of the path of travel, "blocked" for example.

A tunnel may also be used as an obstacle of gameplay. The tunnel has a plurality of elevations rotatably mounted to the playing surface. The peripheral elevations are higher than the central elevations, and sit flush with an elevation on the playing surface when the tunnel is in a first position. The tunnel's elevations contain at least one segmented path of travel. The tunnel optionally includes a cover disposed on the top of the tunnel to simulate a tunnel feel. The tunnel may include additional a segmented path(s) of travel extending from at least one of the plurality of elevations.

A hidden compartment may serve as an obstacle of play. The hidden compartment includes a compartment element, such as a plastic disk, with at least one designated compartments formed into its face and adapted to accept at least one play element. Some examples of play elements include trophies or treasures. The hidden compartment is rotatably connected to the game board, such that the designated compartment aligns with at least one window in the playing surface. A knob extends above the playing surface and connects with the hidden compartment element, allowing a player to rotate the compartments. The hidden compartment may also include a cover adapted to fit on the at least one window, thereby obstructing a players's view of the play elements hidden in the compartments.

Another potential obstacle is a vertical obstacle comprising a vertical member mounted on the face of the playing surface, and straddling a path of travel. The vertical obstacle includes a wheel rotatably connected to the vertical member, with at least one cut-out in the wheel. As a player rotates the wheel, the cut-outs permit travel along the path of travel, thereby traversing the vertical obstacle. An example of a vertical obstacle is a gate, with closed bars illustrated on the wheel to illustrate the path of travel is obstructed.

A reciprocating arm may also be included as an obstacle. The reciprocating arm uses a rotating element pivotally connected to the playing surface forming an axis of rotation. An arm is pivotally connected to the rotating element at a location different from the rotating element's axis of rotation. The arm extends onto the playing surface and has indicia of travel disposed on the face of the arm, such as an illustration of rope or hair to show a path of travel or a tentacle to obstruct travel.

Another potential obstacle is rotating vehicles. The rotating vehicles are playing spaces printed on a disc or arm pivotally connected to the playing surface. Alternatively, the vehicles may be a sliding vehicle comprising a track disposed on the playing surface. The vehicle is adapted to engage the track and linearly traverse the track. At least one playable space is disposed on the vehicle.

Each player begins with at least one marker, player-piece. A player-action generator, or generators, dictate how many segments each player can move on any given turn. The player-action generator also controls when a player is allowed to move an obstacle, either to that player's benefit or an opposing player's detriment.

Movement through the path of travel can be controlled by any means known in the art, such as movement or action cards, dice, or a spinner. In one embodiment, player-movement cards are coupled with player-action cards. Player movement cards are generally related to the number of segments a player can advance. Movement can be expressly stated, as in "move 6 spaces," or can be tied to a random number generator such as dice, i.e. "roll a six-sided die and move that number of spaces."

Player-action cards instruct players on activities not directly tied to movement. For example one player-action may be "select two obstacles and their positions." This would allow a player to either advance his own movement or hinder the movement of an opponent. The first player to move his marker, or all of his markers, to an exit is declared the winner.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

As used herein, "slide" means to linearly move along a surface. The object sliding across a surface may do so in a number of ways, such as by gliding over the surface. Alternatively, the object may have wheels, which rotate allowing the object to linearly move across the surface. The object sliding may move over a surface or with a smooth, gliding motion. However, it is not a requirement that the object move smoothly.

Figure 1:
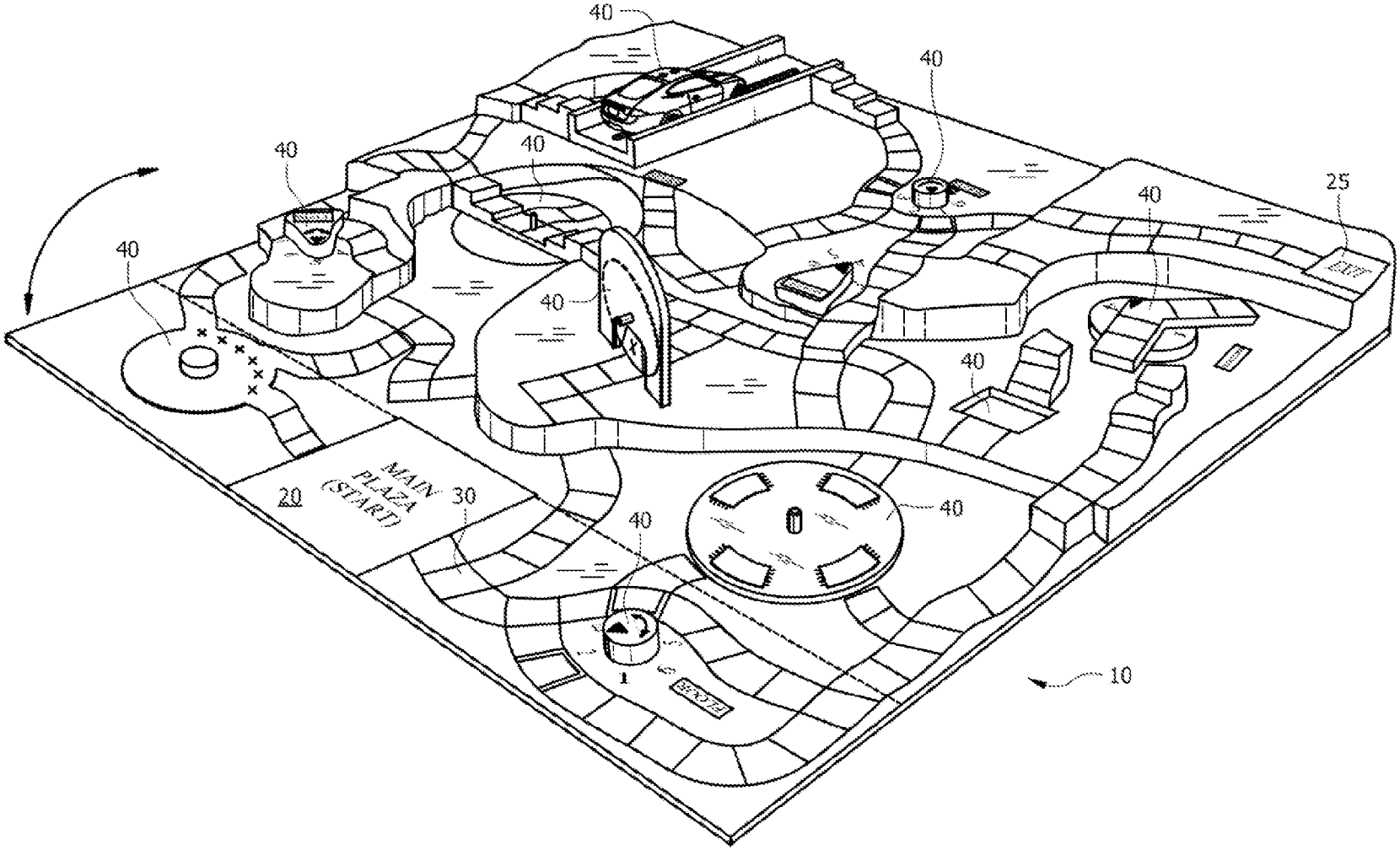
FIG. 1 is a plan view of the game board illustrating potential locations for start and end locations, exemplary locations of moveable obstacles, and elevated playing surfaces.

Board game playing surface 10 is composed of multiple elevated playing levels 20 constructed of lightweight materials, seen in FIG. 1. The panel is substantially rectangular in shape but the shape, size and configuration may vary without deviating from the present invention. For example, the game board can be square, oval, circular, polygonal or of any size and shape. Moreover, it is conceivable that the game board be constructed of a pliable sheet material.

A series of paths 30 are delineated on playing surface 10, beginning at start location 31. The paths then traverse the playing surface 10 from the start location to an end location, with at least some of paths 30 traversing the multiple elevated playing levels 20*a*, 20*b*, 20*c*. Paths 30 include sections that abut an obstacle, thereby causing the path to terminate in either a dead end 35*a* or to adjoin another path.

At least one moving obstacle 40 is positioned on playing surface 10, as shown in FIG. 1. The moveable obstacles can take many forms, as described below, but characteristically permit travel along path 30 under certain circumstances, while denying travel under different circumstances. Strategic use of the obstacles allows a player to accomplish both objectives simultaneously.

Obstacle-Structures

Transferable obstacle 40*a* is a gameboard element 40*a*$^1$ comprising a segmented path of travel on its face and obstacle

40$a^2$ built on the face. The gameboard element may be a piece of compact foam, plastic, or other material which holds shape, formed into for example a square element, shown in FIG. 2(*a*). In this example, obstacle 40$a^2$ is a moveable-wall structure fixed to gameboard element 40$a^4$ and comprises an elevated surface 40$a^3$ rotatably connected to the gameboard element face, such that the elevated surface may be moved to positions 1 through 6. However, transferable obstacle 40*a* could contain any of the disclosed obstacles or obstacles described below or in Greenawalt (U.S. patent application Ser. No. 11/306,682). At least one pocket 40$a^4$ is disposed on playing surface 10. Pocket 40$a^4$ is an opening in the gameboard, adapted to accept gameboard element 40$a^1$, allowing transferable obstacle 40*a* to be placed in any of pocket 40$a^4$. Transferable obstacle 40*a* may also be interchanged with any other transferable obstacle 40*a* in a second pocket 40$a^4$. Depending on the thickness of gameboard element 40$a^1$, transferable obstacle 40*a* fits flush in the face of the playing surface, or may extend beyond the playing surface to form an elevation. When gameboard element 40$a^1$ is placed into pocket 40$a^4$, elevated surface 40$a^3$ forms a wall which blocks a path of travel when in positions 5, 6 and 1.

Other exemplary transferable obstacles 40$a^2$ include a rotating bridge 50 and rotating stairs 60. While the point of rotation for the obstacles can vary, such as being pivoted at either end, it generally resides in the center of the obstacle. For example, a central pivot on bridge 50*a* allows bridge 40*a* to be moved to positions 1 through 6. Bridge 40*a* connects a path of travel on an elevation to another path of travel on the same elevation when placed in position 5. Rotating the bridge to positions 1 through 4 or 6 path causes the two ends of the bridge to terminate in a dead-end and the path of travel to be interrupted. The position of inaccessibility of a bridge provides illustration of potential game strategy. If an opposing players marker resides on a bridge, it may be possible for a player to move the bridge to a position of inaccessibility, position 4 for example. The opposing player would thereby be trapped and unable to move until he is able to move the bridge Where transferable obstacles 40$a^2$ are rotating stairs 60, the stairs are rotatably mounted to game board 10 having an axis of rotation 42 located at either the bottom of the stairs, i.e. at the lowest elevation of the stairs, the top of the stairs, or at the approximate midpoint. Rotating stairs 60 may be moved to positions 1 through 6. In the example, stairs 40*a* connect a path of travel on elevation 20*a* with a path of travel 20*b* when the bottom of the stairs is in positions 3, 4 or 5 as indicated on game board 10. Stairs 40*a* end in a dead-end when in positions 1, 2 or 6.

Figure 2A:
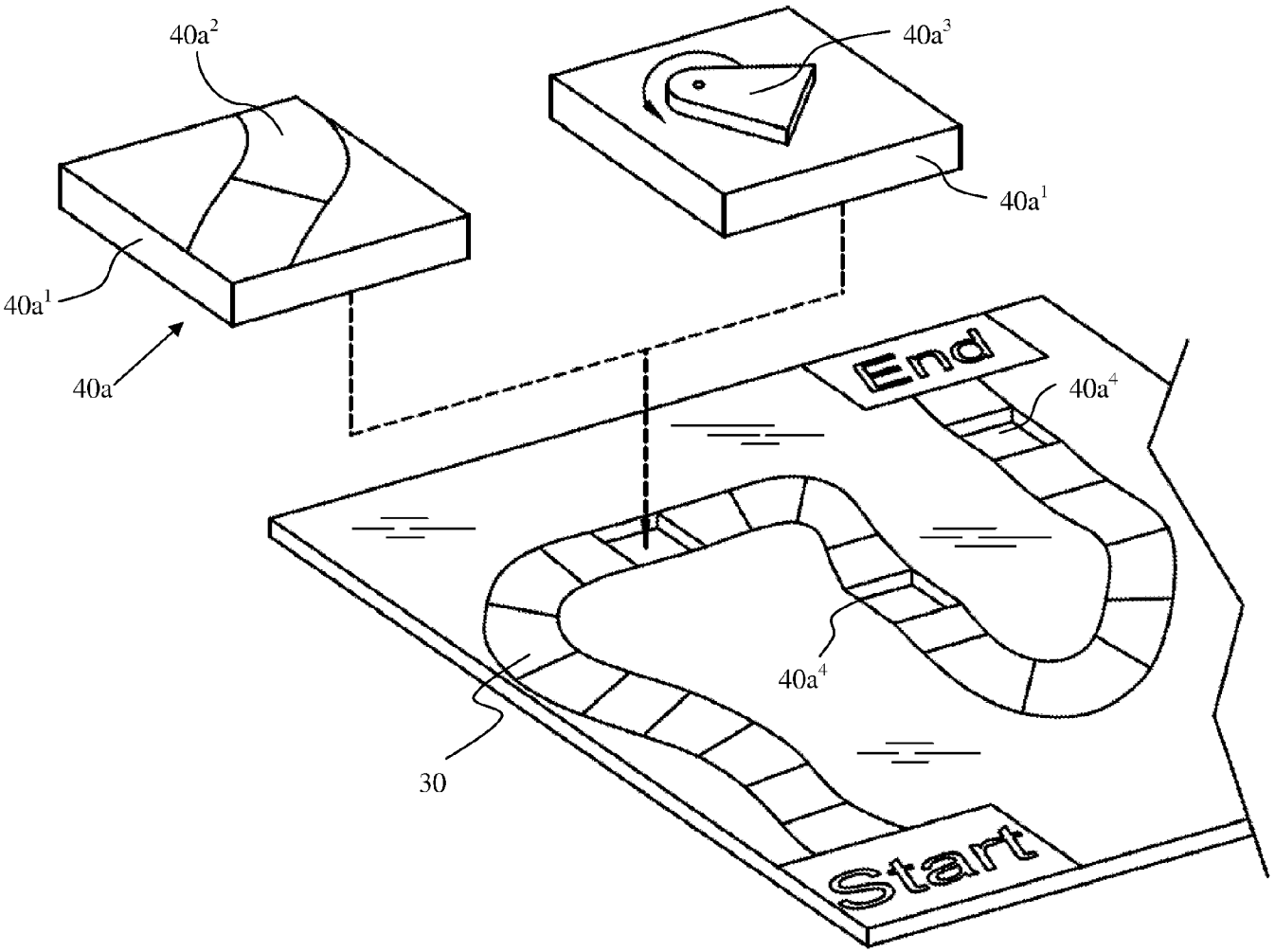
FIGS. 2(*a*) and (*b*) are close-up views of a transferable obstacle. (A) shows one embodiment of the transferrable obstacle, having a rotatable wall. (B) shows another embodiment of the wall-element on the transferable obstacle with an additional path of travel on the top face of elevated surface of the wall.
Figure 2B:
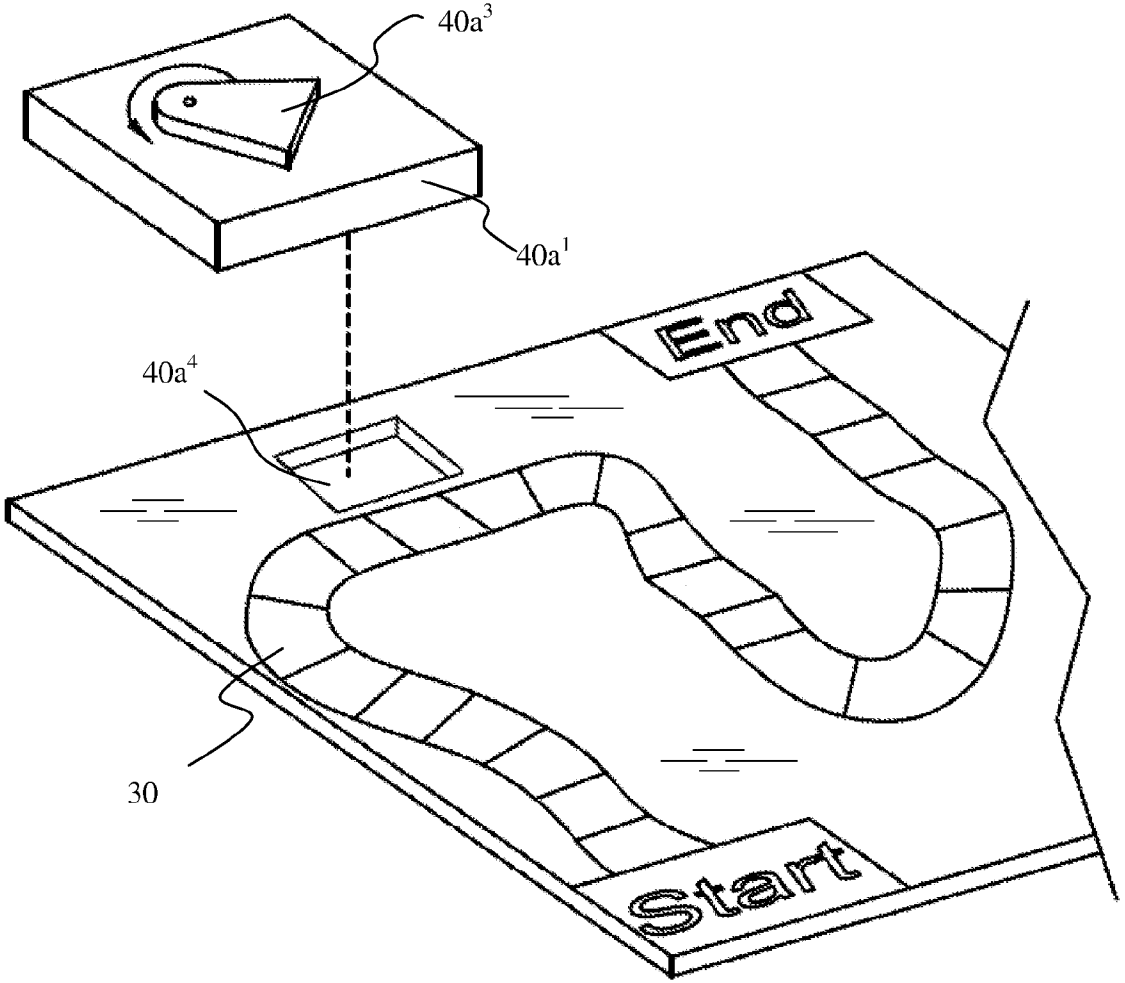

Additional exemplary obstacles disposed on transferable obstacle 40*a* include spinning floor element 40*b*, tunnel 40*c*, rotating hidden compartment element 40*d*, vertical obstacle 40*e*, reciprocating arm 40*f*, rotating vehicles 40*g*, sliding vehicle 40*h*, and pivoting vehicle 40*i*. Transferable obstacle 40*a* can optionally include an additional path of travel on the top face of elevated surface 40$a^3$, as seen in FIG. 2(*b*). In such instances, elevated surface 40$a^3$ operates as described above for any paths of travel disposed on the gameboard element 40$a^1$. However, when transferable obstacle 40*a* is adjacent to an elevated surface, such as 20*a*, 20*b*, or 20*c*, play tokens may also use the path on elevated surface 40$a^3$ to traverse a path of travel on the elevated surface. In other embodiments, the moveable element is a disc with a peripheral path of travel delineated its face by radial division lines to form at least one cell.

Figure 3:
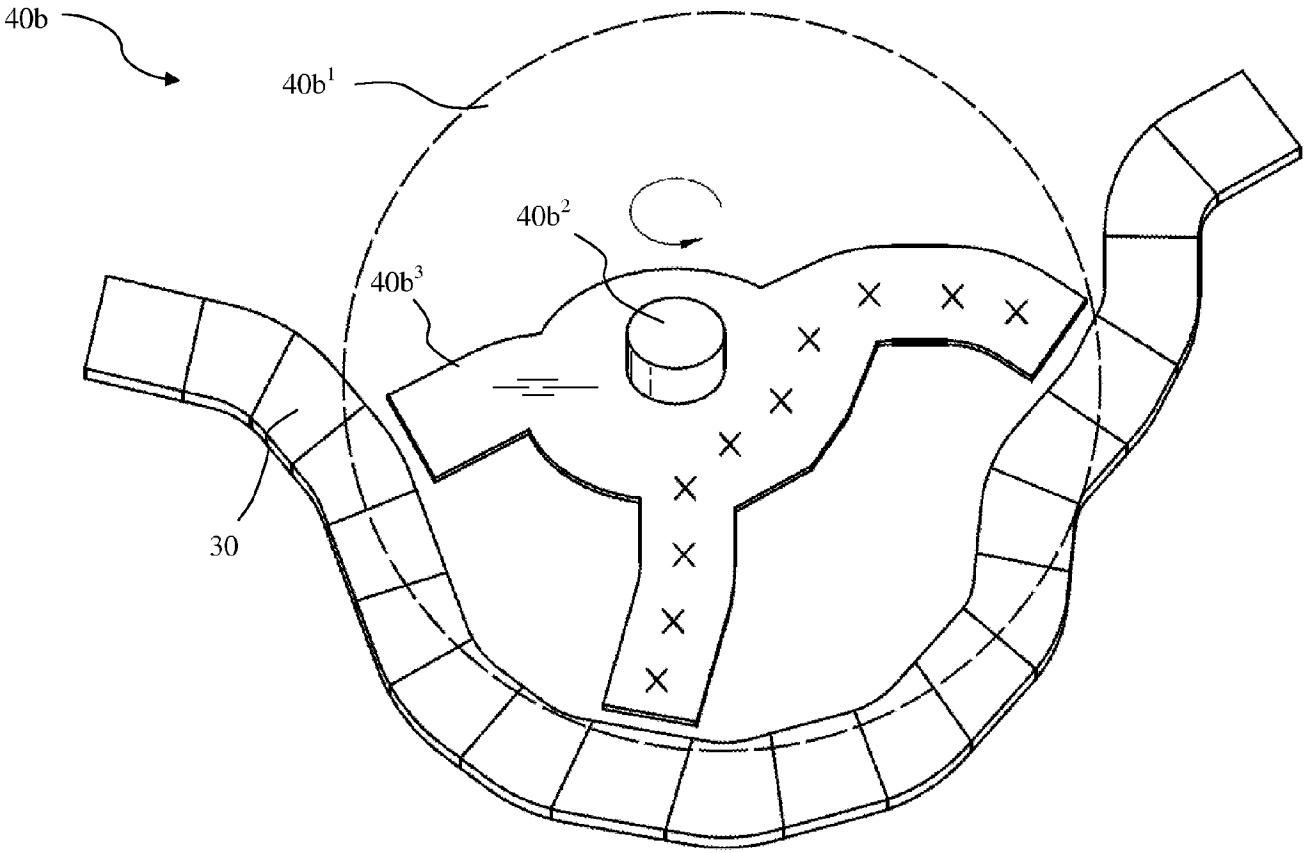
FIG. 3 is a close-up view of a spinning floor element with three points of entry/exit and a series of "X" markings indicating the markings indicating permissible travel paths.

Moving obstacle 40 may be spinning floor element 40*b*. An opening is disposed on playing surface 10 or elevation 20, forming a window for the spinning obstacle, with at least a portion of the playing surface extending to the pivot point of the spinning floor element. Rotating element 40$b^1$ is pivotally connected to the playing surface, with knob 40$b^2$ extending from the board to permit a player to spin the obstacle. The rotating element contains markings showing permissible travel along a path shown on the element or showing that the path is obstructed and cannot be traveled. Window 40$b^3$ is a silhouette of at least one possible path of travel, and allows the markings on rotating element 40$b^1$ to be seen on the playing surface. FIG. 3 illustrates the obstacle, with a series of "X" markings indicating the markings indicating permissible travel paths. In the illustrative example, the spinning floor element connects two of three path segments. In other positions, the "X" markings would permit travel in any direction or obstruct travel to any of the paths, or all paths. The spinning floor element is randomly spun, similar to a roulette wheel, resulting in dynamic paths of travel.

Figure 4A:
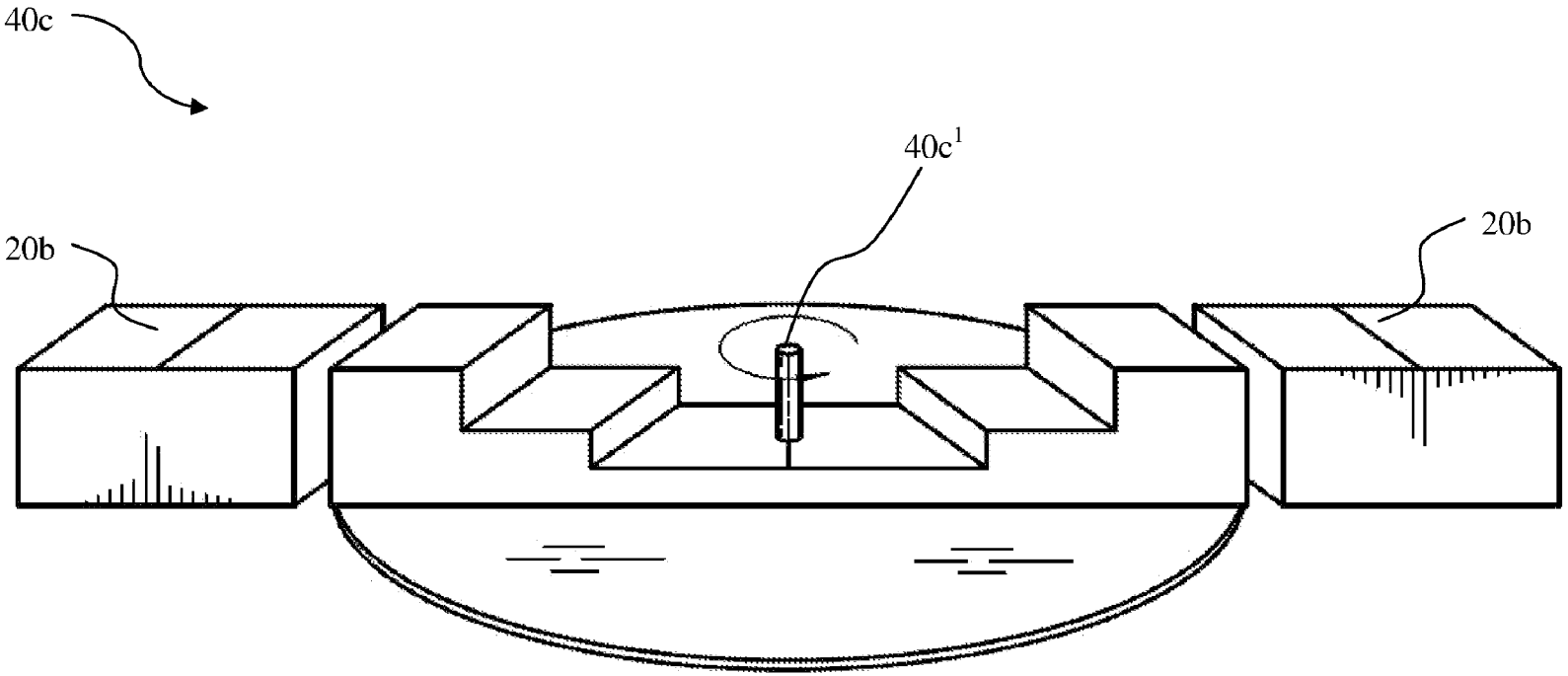
FIGS. 4(*a*) and (*b*) are close-up views of a tunnel. (A) shows the tunnel with a series of elevations, similar to stairs, with the peripheral edges elevated, (B) shows an embodiment of the tunnel with an additional path extending from the lower levels of the tunnel.
Figure 4B:
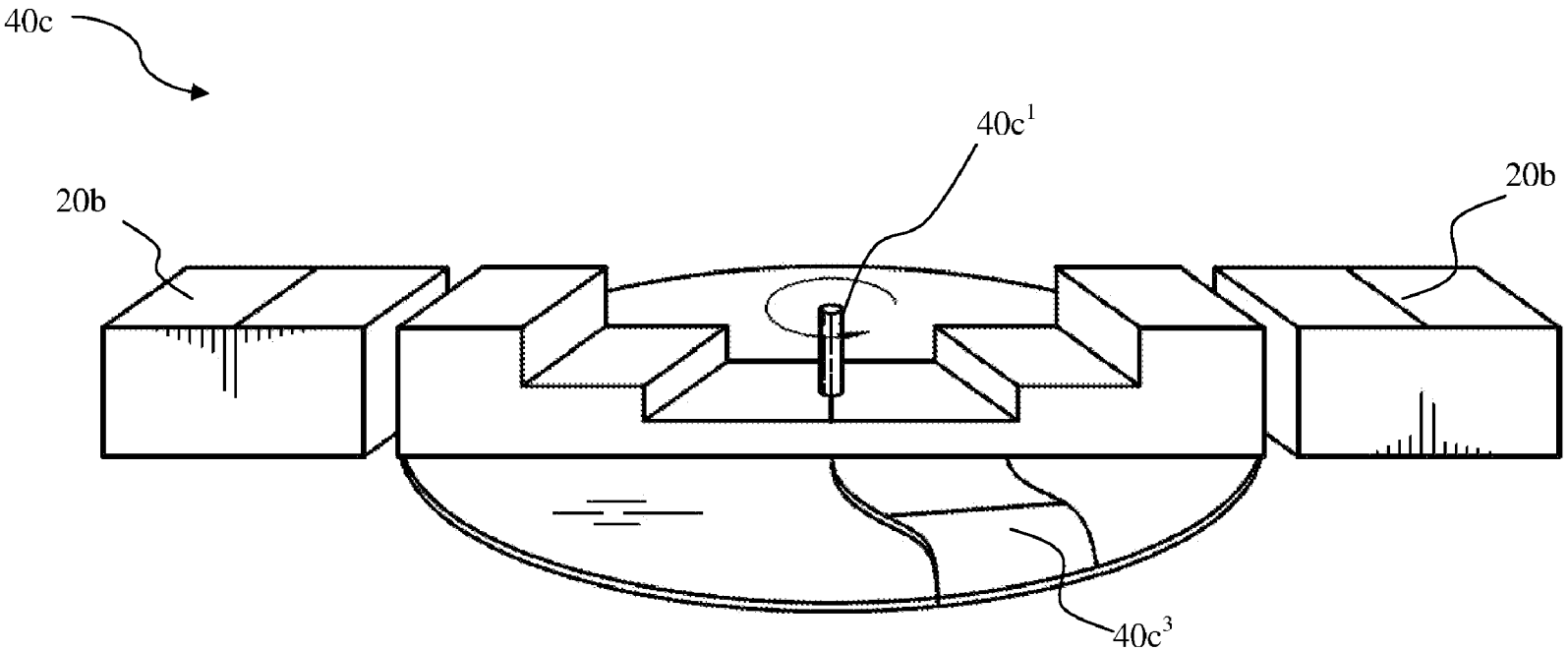
Figure 5:
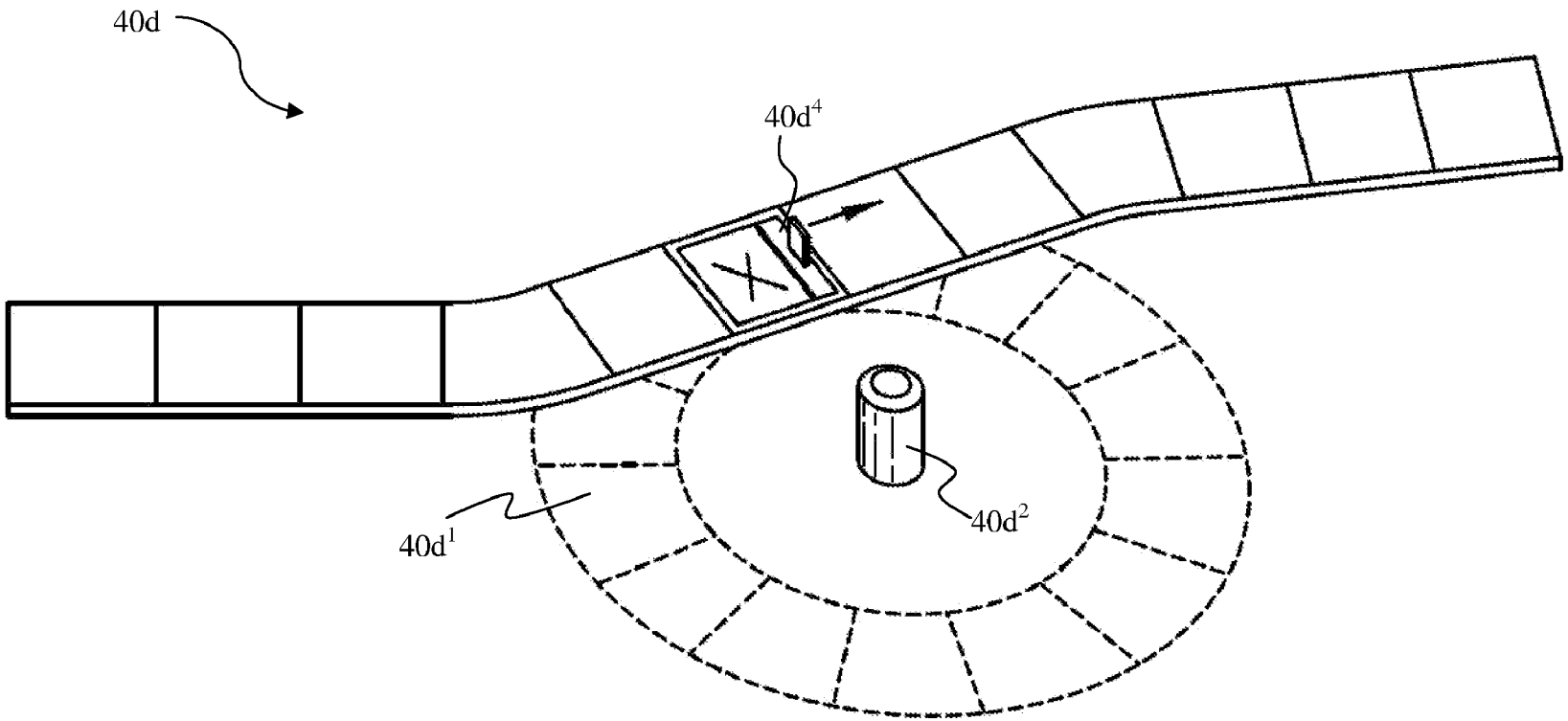
FIG. 5 is a close-up view of a rotating hidden compartment element.

Moving obstacle 40 may alternatively be tunnel 40*c*, seen in FIGS. 5(*a*) and (*b*). The tunnel is disposed in a series of elevations, similar to stairs, with the peripheral edges elevated, i.e. higher, than the center of the tunnel. The tunnel is rotatably mounted to game board 10 with an axis of rotation 40$c^1$ located at the center of the tunnel. Arrow indicator A illustrates the path of travel along tunnel 40*c*, seen in FIG. 4(*a*). In the example, tunnel 40*c* connects a path of elevated surface 20*b* to an adjacent path of elevated surface 20*b*. To add realism, the tunnel may also include a cover or upper face to indicate that the obstacle is a tunnel. Rotating the tunnel causes tunnel 40*c* to end in a dead-end, preventing further travel until to tunnel path is realigned with a path of travel. The tunnel may also include optional paths extending from the lower levels of the tunnel, as seen in FIG. 4(*b*). For example, alternative path 40$c^2$ adjoins tunnel segment III, allowing the player to continue along the tunnel path or select alternative path 40$c^2$. In such embodiments, alternative path 40$c^2$ may be on the same elevation as the original path of travel, i.e. 20*b*, or may be on a different elevation, such as 20*c*.

Moving obstacle 40 may also be a rotating hidden compartment element 40*d*. Hidden compartment element 40*d* is shown as a plastic circular member with designated compartments 40$d^1$ formed into the face of hidden compartment element 40*d*, as seen in FIG. 5. However, the compartment element may be any shape and formed from any material which is relatively lightweight and holds shape. Knob 40$d^2$ is fixed to hidden compartment element 40*d* is and extends through playing surface 10 or elevation 20 to permit a player to rotate the obstacle. Further, knob 40$d^1$ may be shaped as any structure, such as an obelisk, statue, tower, or a cylindrical knob. At least one window is disposed in the playing surface to permit item 40$d^3$ to be loaded into the obstacle, and later retrieved. At the beginning of game play, item 40$d^3$ is placed into designated compartments 40$d^1$ and hidden compartment element 40*d* is covered with cover 40$d^4$ so the player does not know what item is stored in the compartment until the cover is removed. Hidden compartment element 40*d* is then rotated, thereby "shuffling" item 40$d^3$ under the at least one window.

Figure 6:
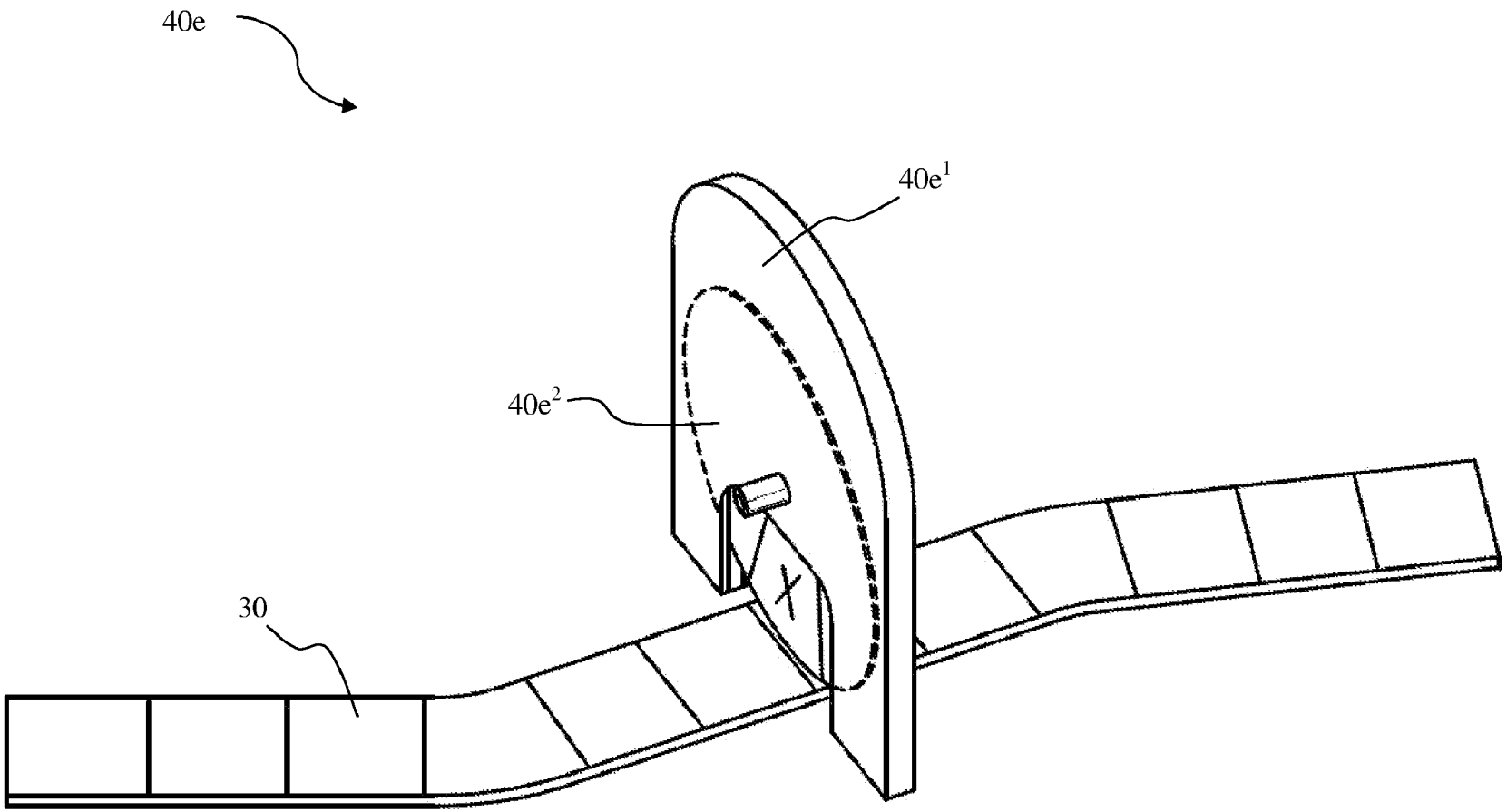
FIG. 6 is a close-up view of a vertical obstacle, seen as a pop-up gate with an image of a closed gate, indicating travel is impeded.

Vertical obstacle 40*e* comprises vertical member 40$e^1$, for example a pop-up gate seen in FIG. 6. Vertical member 40$e^1$ spans a path of travel, and encases rotatable wheel 40$e^2$, which may be set at positions 1 through 5. Rotatable wheel 40$e^2$ includes sections which block the path of travel, while other sections are cut-out, thereby allowing passage through the obstacle. For example, positions 1, 3, and 5 possess obstacles which block travel through vertical obstacle 40*e*. A graphic is placed on the rotatable wheel 40$e^2$, such as an image of a closed gate, showing travel is impeded. Rotating rotatable wheel 40$e^2$ to positions 2, 4, and 6, with the cut-out, indicate an open obstacle and permit passage along the path of travel.

Figure 7:
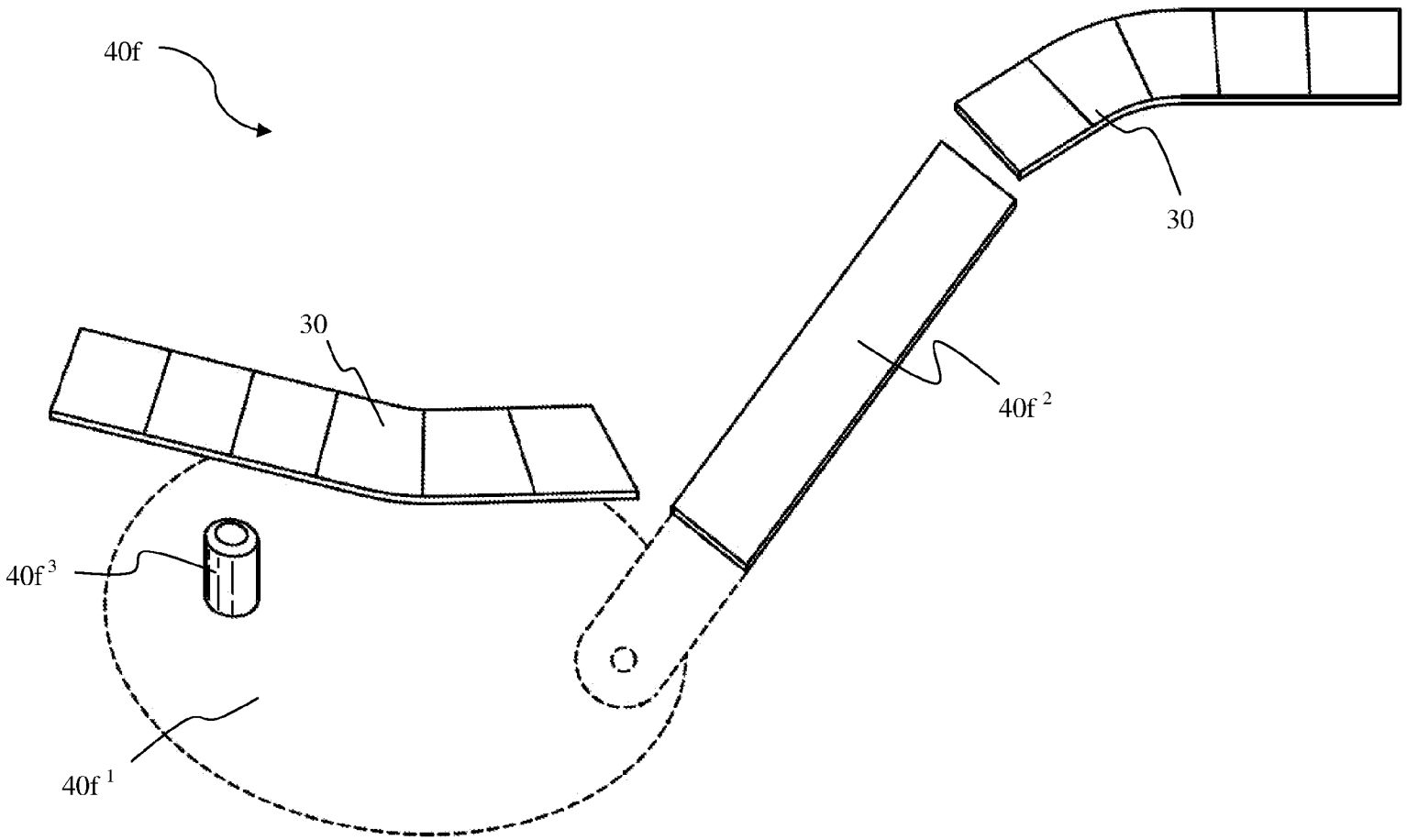
FIG. 7 is a close-up view of a reciprocating arm, where the arm is printed with hair, indicating permissible travel along the arm.

Moving obstacle 40 may be reciprocating arm 40*f*. Reciprocating arm 40*f* may represent a path of travel or alternatively an obstacle, such as a tentacle. Reciprocating arm 40*f* is comprised of rotating element 40$f^1$ pivotally connected to the playing surface, as seen in FIG. 7. While rotating element 40$f^1$ may be connected to the playing surface at any location on the rotating element, rotating element 40$f^1$ is generally connected at about its center to the playing surface. In the embodiment depicted in FIG. 7, an opening in the playing surface allows a player to rotate the rotating element. Position indicators 1 through 6 are printed on rotating element 40$f^1$, and visible either on the exposed surface of rotating element 40$f^1$ or a window in the playing surface allows the player to visualize the position indicator. A player advances the rotating element during play by rotating the rotating element along its periphery. Alternatively, knob 40$f^3$, similar to knob 40$d^1$, may be used to move rotating element 40$f^1$. Arm 40$f^2$ is pivotally connected to the periphery of rotating element 40$f^1$ at one end of arm 40$f^2$. The other end of arm 40$f^2$ extends through the playing surface, and is visible on the playing surface. As rotating element 40$f^1$ moves, it advances arm 40$f^2$ on a parabolic path. Arm 40$f^2$ contains markings, such as rope or hair, indicating permissible travel along the arm.

Figure 8:
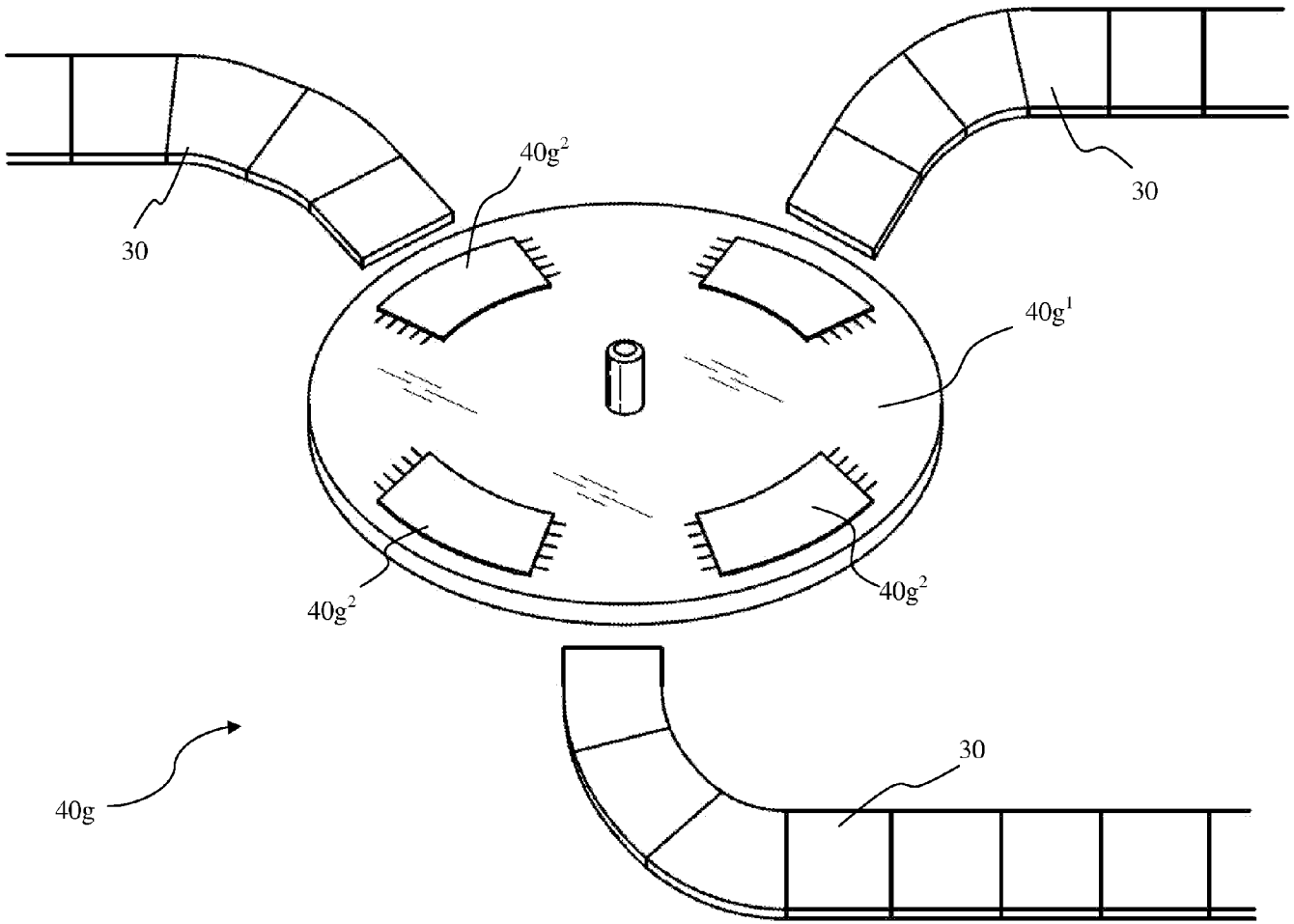
FIG. 8 is a close-up view of a rotating vehicle, shown as flying carpets.

Moving obstacle 40 may alternatively be rotating vehicles 40*g*, which are described as flying carpets. However, other vehicles are envisioned, such as automobiles, trains, boats, helicopters. A clear plastic disc 40$g^1$ is rotatable mounted to the playing surface of the game board. In certain embodiments, disc 40$g^1$ is preferably mounted on an elongated pivot or elevated surface, such that the disc gives the impression of floating, as seen in FIG. 8. Playable spaces 40$g^2$ are illustrated with images of a carpet are printed on the face of the plastic disc to simulate a flying carpet and designate playable surfaces. The plastic disc is adjacent to two elevations 20*b* at the same height. Paths of travel are printed on these elevations, adjacent to the plastic disc, allowing a player to move onto a flying carpet. On a subsequent turn, the plastic disc is rotated, moving the player to another path.

Figure 9:
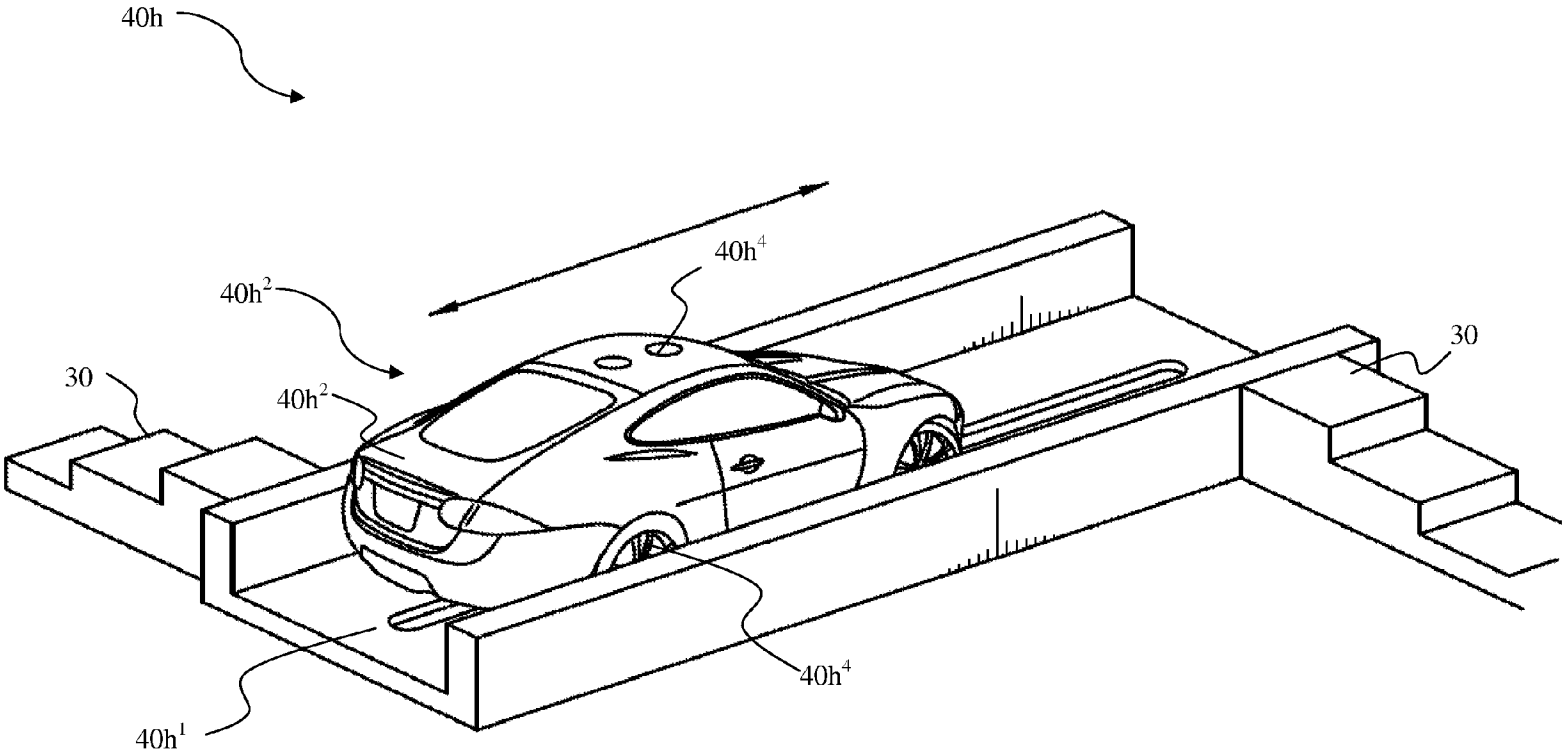
FIG. 9 is a close-up view of a sliding vehicle, shown as a three dimensional automobile in a grooved track.

Moving obstacle 40 can also take the form of sliding vehicle 40*h*, as shown in FIG. 9. Sliding obstacle 40*h* is comprised of track 40$h^1$ and vehicle 40$h^2$. Track 40$h^1$ is affixed to the playing surface, adjacent to a path of travel, such that the path of travel dead ends at the beginning of the track and resumes at the end of the track, as seen in FIG. 9. Vehicle 40$h^2$ is adapted to slide along track 40$h^1$. For example, vehicle 40$h^2$ may be a sliding element, such as a flat, rectangular piece of plastic or paper. The side edges of vehicle 40$h^2$ are designed to engage a channel in the track, locking vehicle 40$h^2$ from removal, but still allowing vehicle 40$h^2$ to slide along the track. The face of vehicle 40$h^2$ is printed with an image of the vehicle, such as an automobile, airplane, or boat, and playable spaces, to simulate the sliding vehicle. Alternatively, vehicle 40$h^2$ is a three dimensional unit which is placed into a grooved track. The vehicle comprises chassis 40$h^3$ and rotating wheels 40$h^4$ pivotally fixed to chassis 40$h^3$. Body 40$h^5$ is mounted onto chassis 40$h^3$, with playable spaces 40$h^4$ molded into the body of the vehicle. Alternatively, vehicle 40$h^2$ may be a moving obstacle, such as a log. In such embodiments, vehicle 40$h^2$ includes a chassis as mentioned above, with body 40$h^5$ being shaped as a log. At least one playable space is molded into the log. Track 40$h^1$ may have illustrations of water to simulate the log floating down a river. Track 40$h^1$ may also span more than one elevation, by including ramp 40$h^6$ connecting the two elevations. Ramp 40$h^6$ may be any known ramp shape, such as a straight incline or corkscrew.

Moving obstacle 40 may alternatively be pivoting vehicle 40*i*, which is described as an automobile. However, other vehicles are envisioned, such as trains, boats, helicopters. Arm 40$i^1$, which may be made of any material known in the art such as clear plastic, is rotatable mounted to the playing surface of the game board, either at a first end of the arm or at a center point in the arm. Playable spaces 40$i^2$ are fixed to either a second end of the arm, where the first end is rotatably connected to the playing surface, or at both ends of the arm, where the arm is rotatably connected to the playing surface at a center point. Playable spaces 40$i^2$ are illustrated with images of a vehicle, simulating the transportation. Paths of travel on the playable surface run adjacent to playable spaces 40$i^2$, allowing a player to move onto a vehicle. On a subsequent turn, the arm is rotated, moving the player to another path of travel.

Although the previous obstacle-structures comprise a preferred embodiment of the present invention; many other moveable obstacles could be incorporated. Generally speaking; stairs relate to any obstacle-structures which complete a path of travel between at least two points on different elevations of the game board; bridges relate to any obstacle-structures which complete a path of travel between at least two points on the same elevation of the game board; and moveable-wall structures relate to obstacle-structures which interrupt a continual path of travel, even if such interruption creates a new path of travel. It also contemplated that movement of the obstacle-structures be linear (slidable), rather than pivotable.

The image contained on each cell determines the status of the coincident segment. For example, a cell may be blank, indicating normal travel, or contain a picture of fire, a pit, rubble or other obstruction, a snake or other creature indicating the segment is impassable, or the image of some barrier directing movement along one path while cutting off movement along another (where the coincident segment lies at the intersection of more than one path). A player located on the path of travel containing an impassable obstacle is forced to either backtrack or wait until someone moves obstacle-surface 40 allowing movement over coincident segment of the path of travel.

Obstacles may also be combined. For example, a spinning element may be added to the sliding vehicle's track. A window in track 40$h^1$ exposes conditions of the track and whether the vehicle may traverse the complete track. As an illustrative example, where the vehicle is an automobile, an image of a fire or bombed out section of road in the window would indicate that the vehicle's path is blocked and prevent the automobile from completing the length of the track until the obstacle is removed.

EXAMPLE

Game Play

An example of rules accompanying the novel board game are included below. The following rules of game play are provided to place the novel board game in context only. Multiple themes, rules and objectives can be incorporated.

Theme: Eccentric billionaire, I. M. Specter, has offered a $10 million prize to the first team to escape from the haunted ruins recently discovered on the Specter estate in Central America. Can you and your team be the first to escape the Haunted Ruins?

Object: Be the first player to move all of your pawns through the ruins.

Contents: (1) Game Board, (4) sets of 4 pawns in red, green, blue and yellow (1) 6-sided die, (1) 12-sided die, (52) Haunted Ruins playing cards, and (4) playing card breakdown sheets.

Setup: a) Shuffle the playing cards and deal 2 cards, face-down to each player. The remainder of the deck is kept face-down for further drawings.

b) The player with the highest die roll starts the game and a pawn color. The selection of pawn color continues clockwise from the starting player.

c) The players agree on the number of pawns to be played based on the following average playing times. 2 players: 3 pawns each in 20-30 minutes or 4 pawns each in 30-40 minutes. 3 players: 3 pawns each in 30-40 minutes or 4 pawns each in 40-50 minutes. 4 players: 2 pawns each in 30-40 minutes or 3 pawns each in 45-55 minutes.

d) Each player places their pawns on the Start space.

e) Roll the 6-sided die to determine the starting position of all 10 obstacles. The obstacle positions are located next to and/or on the obstacle. Set each obstacle to the position number rolled. The obstacles are: (4) floors, (2) bridges, (2) stairways and (2) walls.

I) The player with the highest die roll starts the game with playing continuing clockwise.

Play: 1) The starting player draws the top card from the deck and adds it to the two cards dealt during the setup. The player must play one of those 3 cards and follow the instructions on the played card. The played card is discarded for future replenishment of the deck. Players take one turn at a time with play moving clockwise. During a turn, a player may have to choose between playing "move" cards or "action" cards. "Move" cards require rolling a die and moving the pawns the amount of spaces as rolled. Players can move pawns in any direction including backtracking and back-and-forth. "Action" cards require the changing of obstacles, swapping pawns, or overcoming obstacles. Refer to the Haunted Ruins Cards breakdown sheet to review the breakdown of the 52 cards.

2) When playing a Move card, the player is able to distribute the spaces among multiple pawns. For example, if a 9 is rolled, the player could move one pawn 5 spaces, the second pawn for 3 spaces and the third pawn for 1 space. NOTE: A pawn cannot land on an occupied space. Pawns can be moved in any direction but all of the rolled number must be used. Yellow spaces, in the floors and at the walls, are pass-through only and cannot be occupied between turns.

3) When playing an Action card, the player must follow the instructions on the card and move 6 spaces before, during or after the action. Again, all of the 6 spaces must be used with pawns moved in any direction. NOTE: There will be times when the action is not applicable (i.e. no fire to be extinguished) but the card is still played in order to move 6 spaces. NOTE: When playing a "Select 2 Obstacles & Their Positions" card, a player can not move the same obstacle twice during that turn.

4) Continue playing until a player has moved their pawns to either of the two exits.

Note: If the Haunted Ruins cards are exhausted before a player wins, shuffle the discard deck and resume.

Breakdown of Haunted Ruins Cards:

Move cards: 15 Moves with 6-sided die and 15 Moves with 12-sided die.

22 Action cards: 2 Swap Positions with another Player; 6 Select 2 Obstacles and Positions; 2 Kill Snake with Sword; 2 Extinguish Fire with Water; 1 Roll Die for Position of All Floors; 1 Select Position for All Floors; 1 Roll Die for Position of Both Bridges; 1 Select Position for Both Bridges; 1 Roll Die for Position of Both Stairs; 1 Select Position for Both Stairs; 1 Roll Die for Position of Both Walls; 1 Select Position for Both Walls; 1 Select Position for One Bridge and One Stair; and 1 Select Position for One Floor and One Wall.

Playing Tips: a) Use "Swap Positions" cards very carefully. Try to use these cards when you can move your pawn quickly to an Exit space; b) Try to move pawns equally away from the Start. Don't leave a pawn isolated close to an Exit and thus expose it to a "Swap Positions" card; c) Try to use all of your pawn moves during a turn. Move another pawn if one pawn is blocked by an obstacle. Each move of a pawn is important!; d) Don't panic if you are moving toward an obstacle that is blocking progress because the Ruins are truly haunted and obstacles are constantly changing. The "Select 2 Obstacles & their Positions" cards are very valuable in optimizing your path to exits; e) Continually review the 2 Haunted Ruin cards in your hand and try to develop a strategy to use action cards based on the position of your opponents and the position of the various obstacles; f) Move your pawns along with your opponents' pawns. You may get lucky and be able to take advantage of favorable obstacle positions that they created; g) Haunted Ruins is a game of offense and defense. When given the opportunity to select obstacles don't forget to play some defense by setting up "blocks" on your opponents. The best turns are characterized by one action that helps you and another that hurts an opponent; h) Pay attention to the type of cards played and discarded. For example: if a "Swap Positions" card has been played then you know there is only one left before the deck is reshuffled. This knowledge is invaluable in developing your strategy and anticipating your opponents' strategy; i) To play a slightly faster game; allow the same obstacle to be moved twice in a turn when playing a "Select 2 Obstacles and their Positions" card.

In the preceding specification, all documents, acts, or information disclosed do not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of the dynamic board game, it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention which, as a matter of language, might be said to fall therebetween.

What is claimed is:

1. A board game comprising:

a game board with a game board face, having at least one start location disposed on the game board face;

a plurality of elevated surfaces disposed on the face of the game board;

plurality of segmented paths disposed on the game board face and plurality of elevated surfaces, where the segmented paths begin at the at least one start location;

wherein the game board face and the plurality of elevated surfaces form a playing surface of the game board;

at least one moveable obstacle disposed on the game board, where the at least one moveable obstacle is selected from the group consisting of a transferrable obstacle further comprising:

a gameboard cooperative element adapted to engage a pocket in the gameboard;

an obstacle disposed on the face of the cooperative element;

a spinning floor element, further comprising:

a window disposed on the playing surface;

a rotating element pivotally connected to the playing surface;

a knob in communication with the rotating element;

markings disposed on the face of the rotating element showing obstacles or paths of travel;

a tunnel further comprising:

a plurality of elevations rotatably mounted to the playing surface, wherein the peripheral elevations are higher than the central elevations;

at least one segmented path of travel disposed on the elevations;

wherein the peripheral elevations connect a path of travel on the playing surface when the tunnel is in a first position;

a hidden compartment further comprising:

a compartment housing having an upper face disposed subjacent to the playing surface;

at least one designated compartment formed into the upper face of the compartment housing and adapted to accept at least one play element;

where the compartment housing is rotatably connected to the game board, such that the designated compartment aligns with at least one window in the playing surface;

a knob in communication with the upper face of the compartment housing;

a vertical obstacle element further comprising:

a vertical member disposed on the face of the playing surface, wherein the vertical member has a window disposed adjacent to the playing surface;

a wheel rotatably connected to the vertical member;

wherein the wheel has at least one cut-out in the wheel, such that the cut-out aligns with the window in the vertical member;

a reciprocating arm further comprising:

a rotating element pivotally connected to the playing surface forming an axis of rotation;

an arm pivotally connected to the rotating element;

wherein the arm is not connected at the axis of rotation, where the arm extends onto the playing surface and has indicia of travel disposed on the face of the arm;

a rotating vehicles element further comprising:

a disc or arm pivotally connected to the playing surface;

at least one playable space disposed on the face of the disc or arm; and a sliding vehicle further comprising:

a track disposed on the playing surface;

a vehicle adapted to slidably engage the track, with at least one playable space disposed on the vehicle.

2. The game board of claim 1, wherein the transferable obstacle comprises a segmented path of travel on the face of the cooperative element.

3. The game board of claim 1, wherein the obstacle on the transferable obstacle is selected from the group consisting of:

a moveable-wall structure rotatably disposed on the face of the cooperative element, wherein the moveable-wall structure further comprises a three-dimensional vertical member rotatably disposed on the cooperative member; and a path of travel obstacle further comprising:

a window disposed on the face of the cooperative element;

a disc rotatable disposed under the face of the cooperative element;

a knob in communication with the disc;

at least one peripheral path of travel delineated on the upper face of the disc; where the at least one peripheral path of travel delineated on the upper face of the disc is visible through the window in the cooperative element.

4. The game board of claim 3, wherein the moveable wall further comprises a segmented path of travel disposed on the top face of the wall.

5. The game board of claim 2, wherein the obstacle on the transferable obstacle is selected from the group consisting of:

a pivoting wall structure, further comprising a horizontal member having a first end and a second end, where the first end is pivotally connected to the cooperative element;

where the horizontal member rotates between at least a first position and a second position;

a three-dimensional vertical member disposed on the second end of the horizontal member, such that the vertical member is disposed on one of the segmented paths of travel when the horizontal member is disposed in the second position;

a sliding wall structure, further comprising a horizontal member having a first end and a second end, where the first end and second end are slideably connected to the cooperative element;

where the horizontal member slides between at least a first position and a second position;

a three-dimensional vertical member disposed between the first end and the second end of the horizontal member, such that the vertical member is disposed on one of the segmented paths of travel when the horizontal member is disposed in the second position;

a pivoting bridge, further comprising an elevated pivot surface having the size of about one segment of the segmented path disposed on the cooperative element;

a segmented horizontal member having a first end and a second end;

where the segmented horizontal member is pivotally connected to the elevated pivot surface at the medial section of the segmented horizontal member and rotates between at least a first position and a second position;

where the first end is disposed adjacent to a first segmented path and the second end is disposed adjacent to a second segmented path when disposed in the first position;

a sliding bridge, further comprising a segmented horizontal member having a first end and a second end;

where the first end slideably engages a first elevated surface of the cooperative element and the second end slideably engages a second elevated surface of the cooperative element;

where the segmented horizontal member slides between at least a first position and a second position;

where the first end is disposed adjacent to a first segmented path and the second end is disposed adjacent to a second segmented path when disposed in the first position;

a pivoting segmented staircase, further comprising a first end at a first elevation and a second end at a higher, second elevation, where the first end is disposed adjacent to a first segmented path;

wherein the first end is pivotally connected to the cooperative element and rotates between at least a first position and a second position;

where the second end is disposed adjacent to a second segmented path when the staircase is disposed in the second position;

a pivoting segmented staircase, further comprising a first end at a first elevation and a second end at a higher, second elevation, where the first end is disposed adjacent to a first segmented path;

where the second end is disposed adjacent to a second segmented path when the staircase is disposed in the second position;

wherein the second end is pivotally connected to the cooperative element and rotates between at least a first position and a second position;

a pivoting segmented staircase, further comprising a first end at a first elevation and a second end at a higher, second elevation;

a pivot point disposed in the about center of the pivoting segmented staircase, pivotally connected to the cooperative element such that the pivoting segmented staircase rotates between at least a first position and a second position;

where the first end is disposed adjacent to a first segmented path;

where the second end is disposed adjacent to a second segmented path when the staircase is disposed in the second position;

a sliding segmented staircase, further comprising a first end at a first elevation and a second end at a higher, second elevated surface, where the first end is disposed adjacent to a first segmented path;

wherein the first end is slideably connected to the cooperative element and the second end is slideably connected to a second elevated surface on the cooperative element and slides between at least a first position and a second position;

where the second end is disposed adjacent to a second segmented path when the staircase is disposed in the second position; and a floor, further comprising a horizontal disc member segmented into a plurality of elements;

where the disc member is rotatably connected to the cooperative element, where the plurality of elements are disposed on at least one segmented path;

a knob disposed on the pivot of the disc member.

6. The game board of claim 1, wherein the tunnel further comprises a cover disposed on the upper face of the tunnel.

7. The game board of claim 1, wherein the tunnel further comprises a segmented path of travel extending from one of the plurality of elevations.

8. The game board of claim 1, wherein the hidden compartment further comprises a cover adapted to fit on the at least one window.

9. The board game of claim 1 wherein the at least one moveable obstacle is between at least one path of travel on a first elevation of the playing surface and at least one path of travel on a second elevation of the playing surface when the moveable structure is in the first position.

10. The board game of claim 1 wherein the at least one moveable obstacle is between at least one path of travel on a first elevation of the playing surface and at least one path of travel on the same elevation of the playing surface when the moveable structure is in the first position.

11. The board game of claim 1 wherein the at least one moveable obstacle is at least one-segment of a path of travel.

12. A board game comprising:

a playing surface having a game board face;

at least one start position disposed on the playing surface;

a plurality of elevated surfaces disposed on the game board face;

a first predetermined segmented path of travel, where the first predetermined segmented path begins at the at least one start location;

a second segmented path of travel disposed on the playing surface;

a third segmented path of travel moveable between a first position and a second position;

wherein the third path of travel connects the first and second paths of travel in the first position; and at least one moveable obstacle disposed on the game board, where the at least one moveable obstacle is selected from the group consisting of a transferrable obstacle, further comprising:

a gameboard cooperative element adapted to engage a pocket in the gameboard and an obstacle disposed on the face of the cooperative element;

a spinning floor element, further comprising:

a window disposed on the playing surface;

a rotating element pivotally connected to the playing surface;

a knob in communication with the rotating element;

markings disposed on the face of the rotating element showing obstacles or paths of travel;

a tunnel further comprising:

a plurality of elevations rotatably mounted to the playing surface;

wherein the peripheral elevations are higher than the central elevations;

at least one segmented path of travel disposed on the elevations;

wherein the peripheral elevations connect a path of travel on the playing surface when the tunnel is in a first position;

a hidden compartment element further comprising:

a compartment housing having an upper face disposed subjacent to the playing surface;

at least one designated compartments formed into the upper face of the compartment housing and adapted to accept at least one play element;

where the compartment housing is rotatably connected to the game board, such that the designated compartment aligns with at least one window in the playing surface;

a knob in communication with the upper face of the compartment housing;

a vertical obstacle element further comprising:

a vertical member disposed on the face of the playing surface, wherein the vertical member has a window disposed adjacent to the playing surface;

a wheel rotatably connected to the vertical member;

wherein the wheel has at least one cut-out in the wheel, such that the cut-out aligns with the window in the vertical member;

a reciprocating arm further comprising:

a rotating element pivotally connected to the playing surface forming an axis of rotation;

an arm pivotally connected to the rotating element;

wherein the arm is not connected at the axis of rotation;

where the arm extends onto the playing surface and has indicia of travel disposed on the face of the arm;

a rotating vehicles further comprising:

a disc or arm pivotally connected to the playing surface;

at least one playable space disposed on the face of the disc or arm; and a sliding vehicle further comprising:

a track disposed on the playing surface;

a vehicle adapted to slidably engage the track;

at least one playable space disposed on the vehicle.

13. The board game of claim 12, further comprising a fourth path of travel; wherein the fourth path of travel is between the first and third paths of travel when the third path of travel is in the second position.

14. The board game of claim 12, wherein the third path of travel is not between two paths of travel in the second position.

15. The game board of claim 12, wherein the transferable obstacle comprises a segmented path of travel on its face of the cooperative element.

16. The game board of claim 12, wherein the obstacle on the transferable obstacle is selected from the group consisting of:

a moveable-wall structure rotatably disposed on the face of the cooperative element, wherein the moveable-wall structure further comprises a three-dimensional vertical member rotatably disposed on the cooperative member; and a path of travel obstacle further comprising:

a window disposed on the face of the cooperative element;

a disc rotatably disposed under the face of the cooperative element;

a knob in communication with the disc;

at least one peripheral path of travel delineated on the upper face of the disc;

where the at least one peripheral path of travel delineated on the upper face of the disc is visible through the window in the cooperative element.

17. The game board of claim 16, wherein the obstacle on the transferable obstacle is selected from the group consisting of:

a pivoting wall structure, further comprising a horizontal member having a first end and a second end;

where the first end is pivotally connected to the cooperative element;

where the horizontal member rotates between at least a first position and a second position;

a three-dimensional vertical member disposed on the second end of the horizontal member, such that the vertical member is disposed on one of the segmented paths of travel when the horizontal member is disposed in the second position;

a sliding wall structure, further comprising a horizontal member having a first end and a second end;

where the first end and second end are slideably connected to the cooperative element;

where the horizontal member slides between at least a first position and a second position;

a three-dimensional vertical member disposed between the first end and the second end of the horizontal member, such that the vertical member is disposed on one of the segmented paths of travel when the horizontal member is disposed in the second position;

a pivoting bridge, further comprising an elevated pivot surface having the size of about one segment of the segmented path disposed on the cooperative element;

a segmented horizontal member having a first end and a second end, where the segmented horizontal member is pivotally connected to the elevated pivot surface at the medial section of the segmented horizontal member and rotates between at least a first position and a second position;

where the first end is disposed adjacent to a first segmented path and the second end is disposed adjacent to a second segmented path when disposed in the first position;

a sliding bridge, further comprising a segmented horizontal member having a first end and a second end;

where the first end slideably engages a first elevated surface of the cooperative element and the second end slideably engages a second elevated surface of the cooperative element;

where the segmented horizontal member slides between at least a first position and a second position;

where the first end is disposed adjacent to a first segmented path and the second end is disposed adjacent to a second segmented path when disposed in the first position;

a pivoting segmented staircase, further comprising a first end at a first elevation and a second end at a higher, second elevation, where the first end is disposed adjacent to a first segmented path;

wherein the first end is pivotally connected to the cooperative element and rotates between at least a first position and a second position;

where the second end is disposed adjacent to a second segmented path when the staircase is disposed in the second position;

a pivoting segmented staircase, further comprising a first end at a first elevation and a second end at a higher, second elevation;

where the first end is disposed adjacent to a first segmented path;

where the second end is disposed adjacent to a second segmented path when the staircase is disposed in the second position;

wherein the second end is pivotally connected to the cooperative element and rotates between at least a first position and a second position;

a pivoting segmented staircase, further comprising a first end at a first elevation and a second end at a higher, second elevation;

a pivot point disposed in the about center of the pivoting segmented staircase, pivotally connected to the cooperative element such that the pivoting segmented staircase rotates between at least a first position and a second position;

where the first end is disposed adjacent to a first segmented path;

where the second end is disposed adjacent to a second segmented path when the staircase is disposed in the second position;

a sliding segmented staircase, further comprising a first end at a first elevation and a second end at a higher, second elevated surface;

where the first end is disposed adjacent to a first segmented path and wherein the first end is slideably connected to the cooperative element and the second end is slideably connected to a second elevated surface on the cooperative element;

wherein the first end and second end slide between at least a first position and a second position;

where the second end is disposed adjacent to a second segmented path when the staircase is disposed in the second position; and a floor, further comprising a horizontal disc member segmented into a plurality of elements, where the plurality of elements are disposed on at least one segmented path;

where the disc member is rotatably connected to the cooperative element, a knob disposed on the pivot of the disc member.

18. The game board of claim 16, wherein the moveable wall further comprises a segmented path of travel disposed on the top face of the wall.

19. The game board of claim 12, wherein the tunnel further comprises a cover disposed on the tunnel.

20. The game board of claim 12, wherein the tunnel further comprises a segmented path of travel extending from one of the plurality of elevations.

21. The game board of claim 12, wherein the hidden compartment further comprises a cover adapted to fit on the at least one window.

* * * * *